United States Patent [19]

Thatcher

[11] 4,221,035

[45] Sep. 9, 1980

[54] APPARATUS FOR REMOVAL OF PLASTIC OVERWRAP FROM RECLAIM TOBACCO

[75] Inventor: Richard E. Thatcher, Chesterfield, Va.

[73] Assignee: Philip Morris Incorporated, New York, N.Y.

[21] Appl. No.: 952,463

[22] Filed: Oct. 18, 1978

[51] Int. Cl.[2] ..... B07C 9/00

[52] U.S. Cl. ..... 209/44.1; 209/129; 209/700; 209/629; 209/643

[58] Field of Search ..... 209/629, 700, 643, 129, 209/44.1

[56] References Cited

U.S. PATENT DOCUMENTS

| | | | |
|---|---|---|---|
| 240,907 | 4/1881 | Cowman et al. | 127/68 |
| 871,369 | 11/1907 | Schwarz | 209/441 |
| 1,164,953 | 12/1915 | Mewborne | 209/700 |
| 1,164,986 | 12/1915 | Brockwell et al. | 20/700 |
| 1,822,840 | 9/1931 | Davis | 20/467 |
| 1,956,925 | 5/1934 | Legg | 131/37 |
| 2,485,027 | 10/1949 | Barbee et al. | 209/615 |
| 3,043,429 | 7/1962 | Osmanski | 209/247 |
| 3,067,855 | 12/1962 | Lambert | 198/76 |
| 3,366,125 | 1/1968 | Jackson | 131/96 |
| 3,665,931 | 5/1972 | Mizzan | 131/21 R |
| 3,667,599 | 6/1972 | Hobs | 209/12 |
| 3,866,752 | 2/1975 | Hobbs | 209/12 |

*Primary Examiner*—Allen N. Knowles

*Attorney, Agent, or Firm*—Watson, Leavenworth, Kelton & Taggart

[57] ABSTRACT

The removal of so-called zip-tape from reclaim tobacco is achieved by use of an elongate vibratory conveyor having grooves extending longitudinally therewith and of longitudinal depth profile preselected from groove-containment of the reclaim tobacco, except for the zip-tape content thereof. Rollers having surface affinity for the zip-tape are arranged in overlying relation to the conveyor surface and groove rises, and are disposed in acute angle relation with the conveyor feed direction. The rollers are supported for joint movement with the conveyor so as to be maintained in fixed relation to the conveyor surface during vibration. Zip-tape encountered by the surfaces of the rollers is withdrawn from the conveyor grooves and is displaced successively transversely of the conveyor for collection aside the conveyor.

9 Claims, 4 Drawing Figures

APPARATUS FOR REMOVAL OF PLASTIC OVERWRAP FROM RECLAIM TOBACCO

FIELD OF THE INVENTION

This invention relates to the recovery of reusable tobacco from waste or reclaim tobacco and pertains more particularly to the separation from reclaim tobacco of cigarette plastic package overwrap not removable therefrom by conventional screening techniques.

BACKGROUND OF THE INVENTION

Reclaiming operations in the cigarette industry embrace two principal recovery efforts, one involving operations on individual cigarettes rejected from cigarette makers and the other involving operations on rejected containers of individual cigarettes. The recovery effort involving individual cigarettes is by far the simpler of the two efforts, since a lesser number of removable components are at hand, i.e., tobacco, cigarette paper wrap and, in some instances, filter plugs and filter wrap. The recovery effort involving packaged cigarettes is complicated particularly by the presence of so-called zip-tape, which is the tearable portion of the individual package plastic overwrap, separated from the overwrap on opening the pack by a user. As in such opening, the zip-tape separates from the remnant overwrap in reclaiming on carton and pack ripping, and exhibits the same generally recognized self-sustaining open rectangular configuration. By this configuration characteristic and its relative smallness, the tape eludes customary tight mesh screening efforts, such as involve screens of type shown in applicant's copending, common-assigned patent application Ser. No. 953,859, filed Oct. 23, 1978, entitled "Method and Apparatus for Separating Tobacco from Rejected Cigarettes", which discloses apparatus and system directed to the first-mentioned recovery effort.

By way of further background of the invention, attention is invited to the prior art statement filed herein pursuant to 37 C.F.R. 1.197 and 1.198.

SUMMARY OF THE INVENTION

The present invention has as its object the provision of apparatus for use in the ready separation of heretofore elusive plastic package overwrap from reclaim tobacco.

In attaining this and other objects, the invention provides apparatus inclusive of a vibratory conveyor for receiving reclaim zip-tape laden tobacco and defining a plurality of grooves extending lengthwise of the conveyor, the grooves being selected to have longitudinal depth profile for containment, below the top surface of the conveyor, of all but the plastic overwrap content of the reclaim tobacco supplied thereto. A roller having surface affinity for the plastic overwrap is supported in overlying relation to the top surface of the conveyor and groove rises and is disposed at an acute angle to the conveyor feed direction. The roller is rotated in such sense as to provide movement components for points on the roller surface which are respectively opposite the feed direction and transverse thereto. Zip-tape and other self-sustaining portions of the plastic overwrap extend outwardly of the conveyor grooves to be engaged by the roller surface and withdrawn from the grooves to then be displaced transversely of the feed direction and ultimately removed from the conveyor.

In a particularly preferred embodiment of the apparatus of the invention, such grooves are provided in two sets, mutually spaced lengthwise of the conveyor. Reclaim tobacco is supplied to one groove set. A roller is arranged to overlie each groove set. The supplied groove set rises beyond the location of the roller to a land on the surface of the conveyor and the second groove set receives reclaim tobacco from the land, the land serving as a convenient inspection station for qualification of the reclaim tobacco, and as a resurfacing station for zip-tapes.

The foregoing and other objects and features of the invention will be further understood from the following detailed description of the invention and from the drawings wherein like reference numerals identify like parts throughout.

DESCRIPTION OF THE PREFERRED EMBODIMENTS

Figure 1:
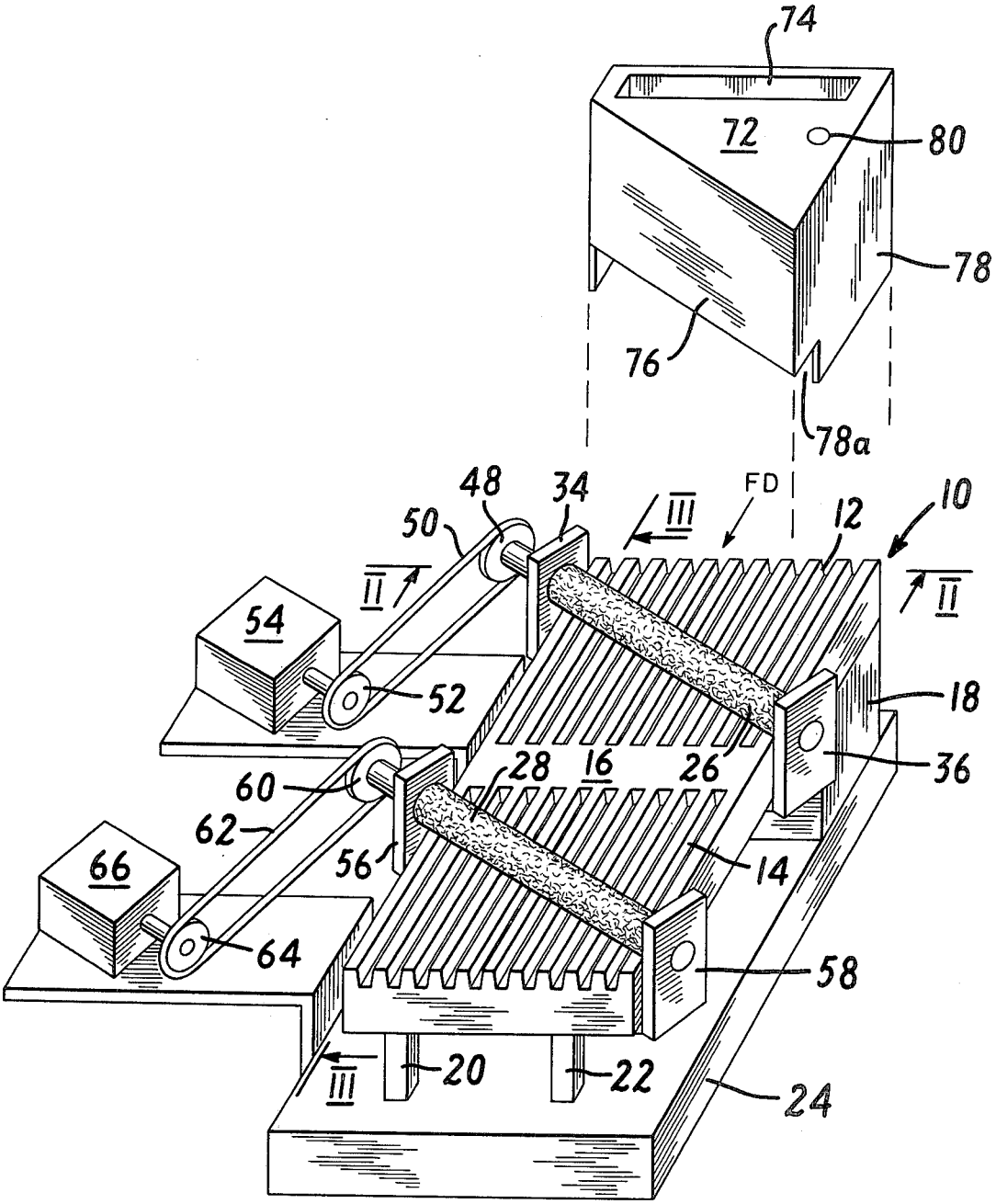
FIG. 1 is a perspective illustration of apparatus according with the invention.

Referring to FIG. 1, conveyor 10 is a vibrating bed, elongate in outline and having longitudinally extending grooves in sets 12 and 14, separated by land 16 which forms a part of the top surface of the conveyor. Groove set 12 is supplied with reclaim tobacco, either by feed apparatus not shown, or manually, at the option of the user. Conveyor 10 is vibrated by drive means 18 on arms 20 and 22, which are resiliently supported in base 24. The conveyor defines a feed direction indicated by arrow FD and reclaim tobacco is advanced by groove set 12 to and beyond roller 26 to land 16 and then by groove set 14 to and beyond roller 28.

Figure 2:
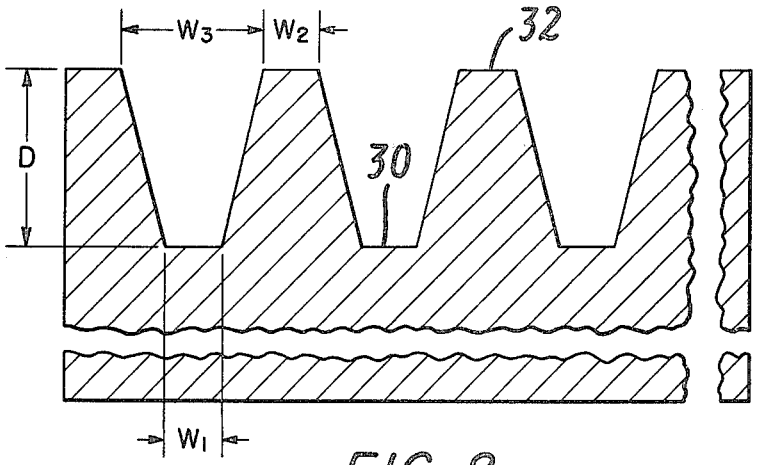
FIG. 2 is a sectional view of the conveyor of FIG. 1 as seen from plane II—II thereof.

As is shown in FIG. 2, the grooves G of the groove sets have floors 30 and are of preselected depth D, effective to contain below flat groove crests 32, the constituents of the supplied reclaim tobacco other than protruding plastic overwrap portions, such as zip-tapes which extend outwardly of crests 32. Reclaim tobacco may readily be supplied to conveyor 10 in composition having essentially only tobacco and plastic overwrap portion content by screening practices which are known to those involved in processing of reclaim tobacco.

Roller 26 is supported for rotation by bearing supports 34 and 36, each of which is fixedly secured to conveyor 10. The roller bearings are disposed in such supports as shown schematically at 38 and 40 in FIG. 4, which also shows acute angle 42 between roller axis 44 and conveyor longitudinal axis 46. Pulley 48 (FIG. 1) is secured to roller 26 and is rotated by flexible belt 50, in turn driven by pulley 52 of rotational drive unit 54. Like support and drive components are provided for roller 28 as shown by supports 56 and 58, pulley 60, flexible belt 62, pulley 64 and rotational drive unit 66. In the course of operation of the described apparatus, rollers 26 and 28 are maintained in uninterrupted contiguous relation with the top surface of conveyor 10, based on the fixed relation of their bearing supports and the conveyor. Flexible belts 50 and 62 absorb the relative deflection between drive units 54 and 66 and the vibrating conveyor.

Figure 3:
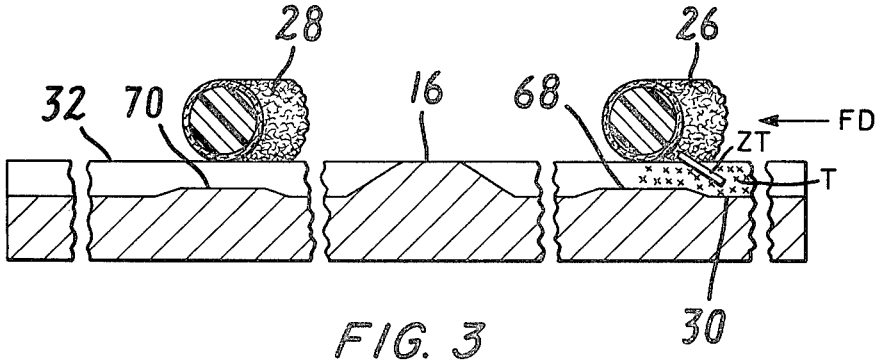
FIG. 3 is a sectional view of the conveyor-roller combination of the FIG. 1 apparatus as seen from plane III—III of FIG. 1.

Referring to FIG. 3, rollers 26 and 28 are rotated counterclockwise. Beneath the rollers in each groove are rises, shown at 68 and 70 in the single cross sectional groove shown in FIG. 3. The longitudinal profile in such groove in feed direction (FD) involves a transition from groove floor 30 upwardly to rise 68 beneath roller 26, downwardly to floor 30 and then upwardly to land 16 which is at the same level with groove crests 32, defining the conveyor top surface jointly therewith. Beyond land 16, the groove recedes to floor 30, ascends to rise 70 beneath roller 28 and again recedes to floor 30. As is shown schematically adjacent roller 26, tobacco T, on encountering rise 68 effectively lifts zip tape ZT into confronting relation with the surface of roller 26. The zip-tapes are accordingly withdrawn from the groove by engagement with the roller surface and, based on the acute angle relation of roller 26 and conveyor 10, the engaged zip-tape is given a movement having components both opposite the feed direction and transverse thereto. The zip-tapes thus are displaced along the roller surface outwardly of the plane of FIG. 3, to be ultimately passed beyond the side margin of the conveyor onto suitable collection apparatus.

Figure 4:
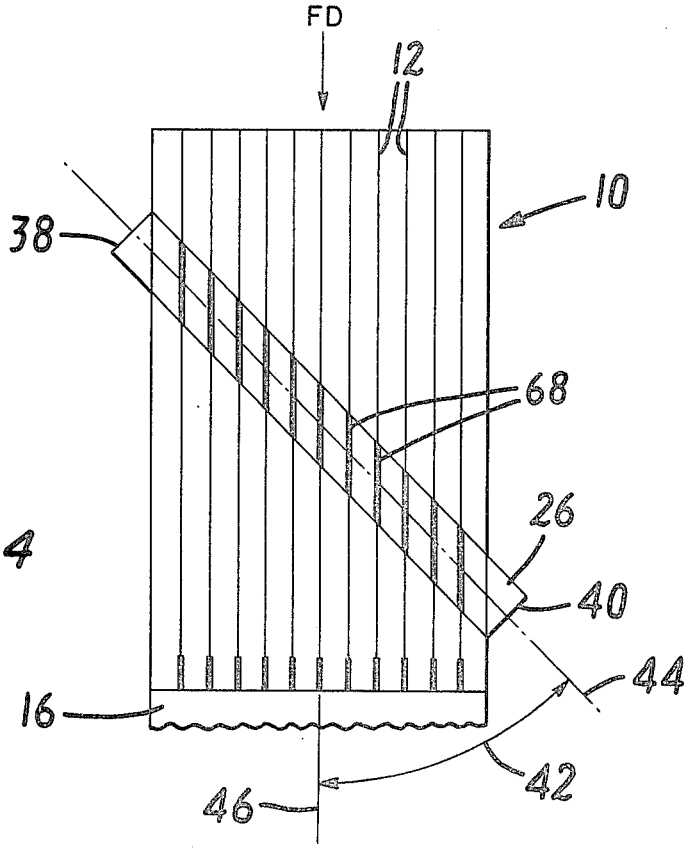
FIG. 4 is a schematic illustration depicting the relative dispositions of roller and groove rises for the FIG. 1 apparatus.

Considering FIG. 4, rises 68 are longitudinally staggered along conveyor axis 46 whereby each rise is disposed beneath roller 26. The groove inclinations leading to land 16 are at common longitudinal disposition in the conveyor. Like configuration attends the inclinations leading from land 16 in the direction of roller 28 and rises 70 are likewise longitudinally staggered in the conveyor to underlie roller 28.

Land 16 provides a convenient inspection station for reclaim tobacco after separation of plastic overwrap content thereof by coaction of groove set 12 and roller 26. The land also functions to cause resurfacing of zip-tape not withdrawn by roller 26 and the feeding thereof to roller 28 atop tobacco in groove set 14.

By way of implementing the affinity characteristic of rollers 26 and 28 for such plastic overwrap as zip-tape, felt has been observed to be a particularly useful roller outer surface. Other surface composition may readily be identified by the artisan, i.e., by noting comparable electrostatic/friction force. The foregoing embodiment may be altered, where inspection and/or resurfacing are not desired, by elimination of the land 16, and the groove set 14. The longitudinal extent of the conveyor may be six feet, with the inspection land located centrally longitudinally and the transverse extent of the conveyor being eighteen inches. Groove depth D is desirably three-quarters of an inch and may lessen to five-eighths of an inch in the reduced depth groove portions above rises 68 and 70. Roller 26 diameter may be five inches and angle 42 is preferably about forty-five degrees. Dimensions $W_1$ and $W_2$ (FIG. 2) may both be about one-quarter of an inch and dimension $W_3$ about five-eighths of an inch.

Unexpectedly improved zip-tape removal is afforded by use of dust hood 72, shown in FIG. 1 upwardly of its seated position on conveyor 10. A tobacco feed opening 74 is formed in the upper surface of the hood and a rear wall and sidewall extend downwardly to the conveyor for dust containment in the feeding reclaim tobacco. Front wall 76 terminates at its lower end atop roller 26 and follows the acute angulation of the roller with the conveyor longitudinal axis. Sidewall 78 defines an opening 78*a* for dispensing of removed zip tape. On application of vacuum pressure to hood upper surface port 80, suction is created locally at roller 26 by the drawing of ambient air over the top of roller 26 through the slight clearance opening between the roller and hood front wall 76. Such local suction assists in holding zip-tape to the surface of the roller, allowing the roller to rapidly dispense tape from the conveyor. In use of the vacuum dust hood, some ninety-eight percent of the zip-tape is removed by roller 26 with the remnant removed by roller 28.

Various changes and modifications evidently may be introduced in the foregoing embodiments, respectively involving plural or single sets of grooves, without departing from the invention. While the invention is directed particularly at zip-tape recovery, it will be seen as applicable to the separation of components having self-sustaining geometrically open configuration sufficiently diverse from that of other components of the reclaim tobacco as to enable recovery thereof by the technique affected by the apparatus of the invention. The particularly disclosed and described embodiments are accordingly intended in an illustrative and not in a limiting sense. The true spirit and scope of the invention will be evident from the following claims.

What is claimed is:

1. Apparatus for use in a tobacco reclaiming operation in the removal of portions of plastic package overwrap of open geometric configuration, said apparatus comprising: elongate vibratory conveyor means for receiving reclaim tobacco laden with such overwrap portions and advancing the same in a feed direction, said conveyor means having a plurality of longitudinally extending grooves spaced mutually transversely of said feed direction; and roller means overlying said conveyor means and supported for rotation about an axis forming an acute angle with the longitudinal axis of said conveyor means, each of said grooves defining a reduced depth portion directly underlying the extent of said roller means overlying such groove.

2. The apparatus claimed in claim 1 wherein said conveyor means defines said grooves in first and second sets spaced longitudinally of said conveyor means, said roller means comprising a roller in overlying relation to each such groove set, said grooves defining such reduced depth portions underlying each such roller.

3. The apparatus claimed in claim 2 wherein said conveyor means includes a longitudinally continuous top surface portion separating said first and second sets of grooves.

4. The apparatus claimed in claim 3 wherein said first set of grooves terminates in said conveyor feed direction in gradually ascending relation to said top surface portion.

5. The apparatus claimed in claim 4 wherein said second set of grooves commences in said conveyor feed direction in gradually descending relation from said top surface portion.

6. The apparatus claimed in claim 1 wherein said roller means comprises a roller, and bearing supports for said roller fixedly secured to said conveyor means at respective different longitudinal locations thereon.

7. The apparatus claimed in claim 6 wherein said roller means includes rotational drive means inclusive of flexible drive means for absorbing deflection as between said rotational drive means and said roller occurring in the course of vibration of said conveyor means.

8. The apparatus claimed in claim 1 including means for creating suction locally of said roller means.

9. The apparatus claimed in claim 8 including a hood member configured to create such local suction and defining an issue port for dispensing of such removed plastic overwrap portions from said conveyor means.

* * * * *